United States Patent [19]

Müller et al.

[11] Patent Number: 4,804,100

[45] Date of Patent: Feb. 14, 1989

[54] CONTAINER ADAPTED FOR USE IN CENTRIFUGE

[75] Inventors: Dieter Müller, Badenhausen; Christian Hirsch, Osterode; Peter Pantucek, Darmstadt, all of Fed. Rep. of Germany

[73] Assignee: Heraeus Separationstechnik GmbH, Osterode am Harz, Fed. Rep. of Germany

[21] Appl. No.: 897,307

[22] Filed: Aug. 18, 1986

[30] Foreign Application Priority Data

Nov. 11, 1985 [DE] Fed. Rep. of Germany ..... 3539916

[51] Int. Cl.[4] ..... B04B 5/00

[52] U.S. Cl. ..... 220/1 R; 220/91; 494/20

[58] Field of Search ..... 220/1 R, 91, DIG. 13; 215/1 R; 494/16, 20

[56] References Cited

U.S. PATENT DOCUMENTS

| | | | |
|---|---|---|---|
| 3,128,905 | 4/1964 | Hesslein | 220/91 X |
| 3,341,047 | 9/1967 | Nauta | 220/95 X |
| 4,032,066 | 6/1977 | Wright | 494/20 |
| 4,148,433 | 4/1979 | Bayley | 494/20 |
| 4,342,419 | 8/1982 | Conway | 494/20 X |
| 4,439,177 | 3/1984 | Conway | 494/20 |
| 4,531,652 | 7/1985 | Hara | 494/20 X |

*Primary Examiner*—Steven M. Pollard
*Attorney, Agent, or Firm*—Felfe & Lynch

[57] ABSTRACT

A centrifuge bowl for oscillating bowl type rotors with two grooves in opposite sides of the bowl to receive the rotor-bearing pins, so that each groove has a bottom surface and is bound on the side facing the bowl aperture by a curved surface is provided. This achieves higher load change cycles so that higher fields of gravity are possible without the occurrence of the usual material fatigue in the area of the grooves receiving the bearing-pins, that is, of fissuration, because the bottom surface has a cup-shaped indentation which, in the peak area of the curved surface is located ajacent to the latter, and there is at least one slot opening into the indentation in the peak area of the curved surface.

6 Claims, 3 Drawing Sheets

CONTAINER ADAPTED FOR USE IN CENTRIFUGE

FIELD OF THE INVENTION

This invention relates to containers, such as bowls, which are used in connection with centrifuge apparatus.

PRIOR ART

Centrifuge bowls are familiar from, e.g, U.S. Pat. No. 4,531,652, and German Patent Specification DE-PS No. 29 38 317. These bowls are used, for example, to accommodate sample bowls or sample tubes, into which separate receptacles may be inserted. The bowls, in use, are inserted into centrifuge rotors, as is described by, e.g., U.S. Pat. No. 4,147,294.

Due to the high pressures and changes in stress to which centrifuge bowls are subject, it is preferable that they be manufactured of an injection molding, such as injection aluminum casing DE-PS No. 29 38 317 describes the use of synthetic materials in the manufacture of these bowls. Even in this case, however, metal parts are inserted to strengthen the device.

The constant stress changes referred to supra, taken with high peak loading during centrifugation, results in frequent fissuration in the area of the grooves of centrifuge bowls which hold rotor bearing pins. Safety reasons compel frequent changing of these bowls, once fissuration begins.

In order to obtain a longer life, or better performance for these bowls, the previous practice has been to decrease the bowl volume. This causes a resulting decrease in specific weight, as well as decreased bowl capacity. Hence, in the interests of safety, more frequent centrifuge runy must be completed with concomitant increases in experimental time, and increased costs.

It is an aim of this invention to provide a centrifuge bowl which, as compared to traditional centrifuge bowls, can withstand higher cycle stress changes and the use of higher gravitational fields, without resulting material fatigue in the area of bearing-pin molding grooves (e.g., fissuration).

SUMMARY OF THE INVENTION

A centrifuge bowl is provided wherein said bowl is provided with a pair of grooves on the exterior surface of the bowl, which are positioned opposite each other. These grooves are characterized by a cup-shaped indentation in their bottom surface, and where said indentation is adjacent to the top area of the curved surface of the bowl. Additionally, in the top area of the curved surface, there is at least one slot which discharges into the groove. Such bowls have produced excellent results in experimental tests.

BRIEF DESCRIPTION OF THE FIGURES

FIG. 1, FIG. 3: A section along Line III—III in FIG. 2; however, the bowl wall is not shown.

DETAILED DESCRIPTION OF PREFERRED EMBODIMENTS

Figure 1:
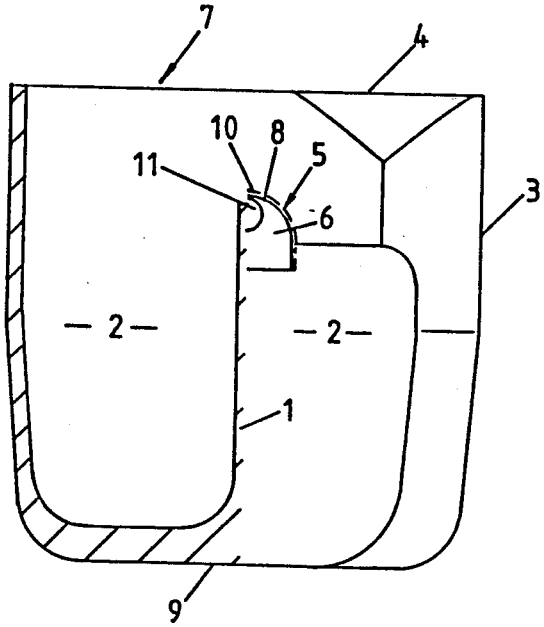
FIG. 1: A cross section through a double blood bag bowl along line 1—1 in FIG. 2, FIG. 2: A top view of the centrifuge bowl as per
Figure 2:
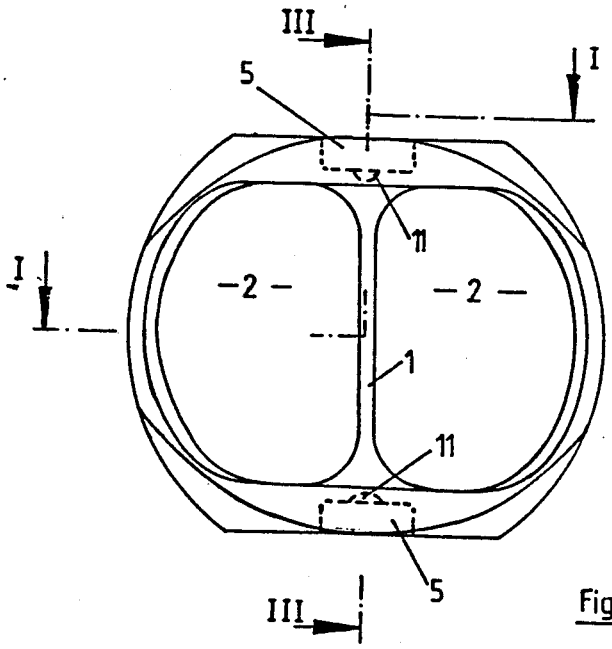

A "double blood bag bowl" is the practical embodiment of the centrifuge bowl which is shown in the illustrations. The bowl volume as can be seen especially in FIGS. 1 and 2, is divided by a deparating wall 1 into two bowl areas 2. In the upper area of the bowl wall 3, located approximately a third of the bowl height down from the upper edge of the bowl 4 toward the middle of the bowl, there are grooves 5 in the opposite outer sides designed to receive rotor bearing-pins (these pins are not illustrated). These grooves 5 are shown to have a flat bottom surface and they are bound on their upper side, toward the edge of the bowl 4 or the bowl aperture 7, by a curved surface 8. Heading downward, that is, toward the bottom 9 of the centrifuge bowl, the groove 5 is open, so that the double blood bag bowl can be placed from above onto the bearing-pins of the centrifuge rotor. In order that the bowl can revolve freely on the rotor bearing-pins, the two opposite outer sides in which there are grooves 5 have been flattened in parallel direction to each other.

Figure 4:
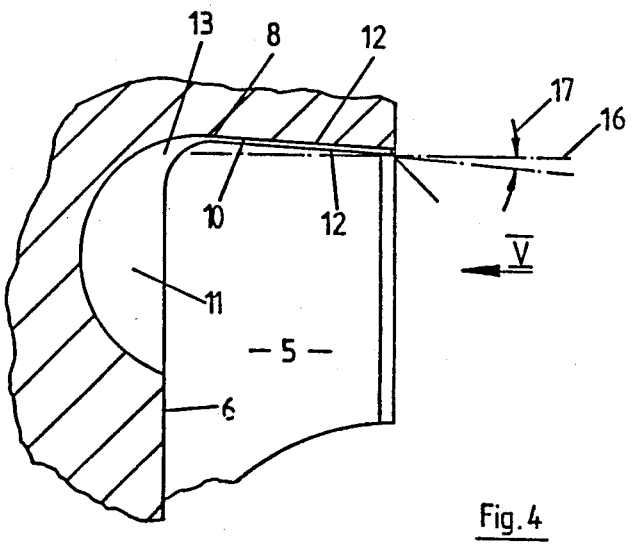
FIG. 4: An enlargement of cutaway segment IV in FIG. 3, FIG. 5: A view in the direction of arrow V in FIG. 4 with a section turned away from the view given in FIG. 4, FIG. 6: A cross section along line VI—VI in FIG. 5.

In traditional centrifuge bowls, because of constant load changes when high cycles have been reached, fine fissures can be observed at the topmost part of the grooves 5, so that these bowls have had to be replaced for reasons of safety. In the case of the centrifuge bowl presented in this invention and illustrated herewith, however, a cup-shaped indentation 11 is provided for in the bottom surface 6 of each groove 5, which indentation is located adjacent to the curved surface 8. In addition, there is a slot 12 at the peak 10 of the curved surface 8, running toward the pivot axis 19 of the rotor bearing-pins; this slot continues over into the cup-shaped indentation 11, as indicated in FIG. 4 by reference number 13. These features, that is, the slot 12 and the cup-shaped indentation 11 effect tension in the cup advantageously in the area of the pin suspension, so that centrifuge bowls constructed on these principles can bear heavier loads without the incidence of the fissure observed in traditional models.

Figure 5:
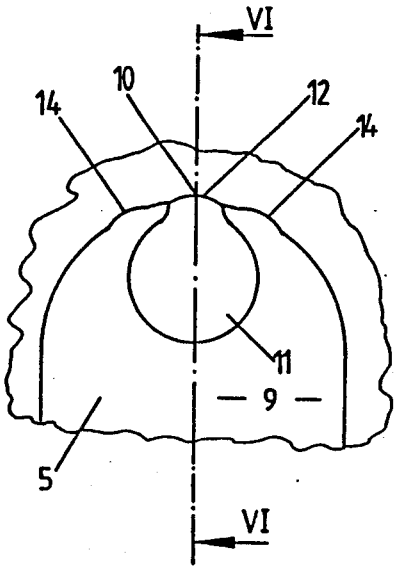
Figure 6:
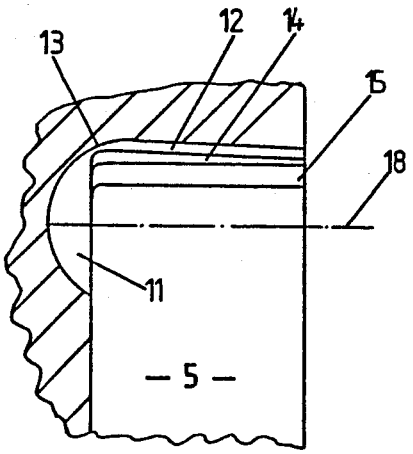

An additional optimizing application of the centrifuge bowl provides, on each side of at least one slot 12, as illustrated in FIG. 4, for at least one more slot 14, to be milled into the curved surface 8, as illustrated in FIG. 5 and 6. While the slot 12 opens into the cup-shaped indentation 11, the other two slots 14 in the present invention in the corner area of the groove 5 formed by the bottom surface 6 and the curved surface 8. Instead of these three slots, a specific embodiment is possible in which there are two slots in the curved surface 8; these two curved slots would then, as illustrated in FIG. 4, end in the cup-shaped indentation 11.

Especially advantageous for tension conditions in the centrifuge bowl is a feature of the groove 5, whereby the curved surface 8 widens in funnel fashion as it approaches the bottom surface 6. By means of this back taper of the curved surface 8, it is possible to have the bowl rest, at the beginning of the centrifuging process, upon the bearing-pins only with its outer edge 15, as illustrated by dotted line 16 in FIG. 4. As velocity and load increase, a warping of the bowl takes place, until a linear contact along the upper side of the pin results. According to the stress (load, rotational speed, etc.) and the resulting warping of the bowl, the angle of the back taper, as illustrated by number 17, should be between 15' (minutes) and 1°.

Figure 3:
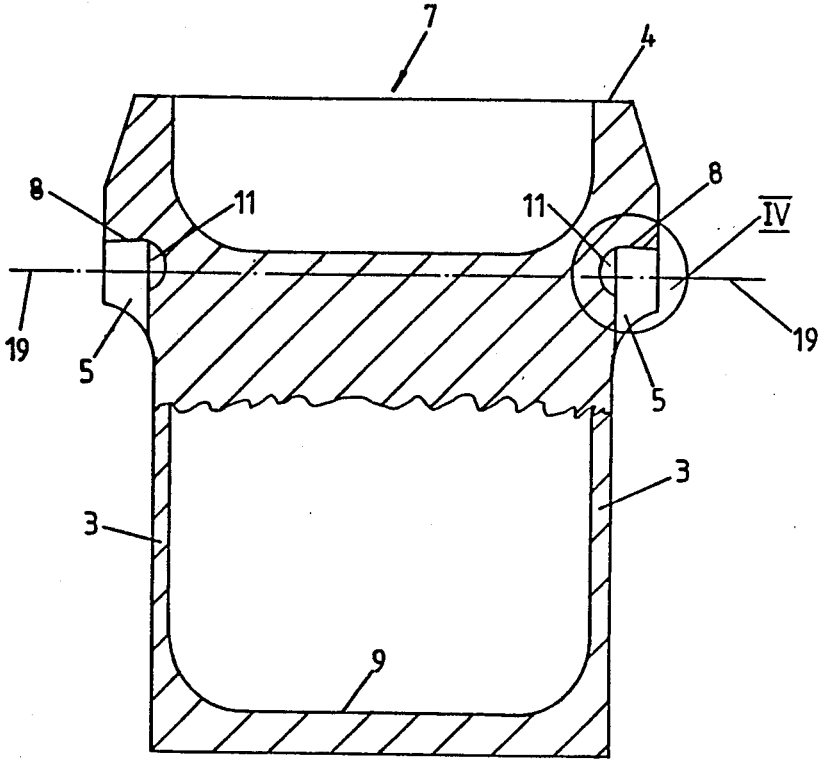

Optimally, the axis 18 of the cup-shaped indentation (see FIG. 6) runs in the direction of the pivot axis 19 (see FIG. 3) of the centrifuge bowl. In addition, the end of at least one slot is part of the cup-shaped recess 11; that is, a cross section of the slot 12 has a radius corresponding to the cup-shaped indentation 11. This feature has the special advantage of permitting the slot 12 and the cup-shaped indentation 11 to be milled in during a single process.

The terms and expressions which have been employed are used as terms of description and not of limitation, and there is no intention in the use of such terms and expressions of excluding any equivalents of the features shown and described or portions thereof, it being recognized that various modifications are possible within the scope of the invention.

We claim:

1. A centrifuge bowl which comprises a bowl having a closed bottom and an open top, the exterior of said surface of said bowl having two two-sided grooves positioned opposite each other and adapted to receive rotor bearing pins, each of said grooves having a closed end and an open end, each of said grooves having a cup-shaped indentation in it's bottom surface, adjacent said closed end, said grooves being bound a curved surface having a peak area at the closed end of said groove adjacent the open top of said bowl, said peak area of said curved surface positioned adjacent to said cup shaped indentation, and said peak area further comprising at least one slot extending from said exterior surface of said bowl to and merging with said cup-shaped indentation.

2. Centrifuge bowl as in claim 1, wherein said peak area comprises a plurality of slots.

3. Centrifuge bowl as in claim 1, wherein the curved surface widens in funnel-like fashion as it approaches the bottom surface of the bowl.

4. Centrifuge bowl as in claim 1, wherein the termination of the slot is itself part of the cup-shaped indentation.

5. Centrifuge bowl as in claim 1, wherein the axis of the indentation runs in the direction of the swivel axis of the bowl.

6. Centrifuge bowl as in claim 3, wherein the curved surface widens at an angle of 15' to 1° to the swivel axis of the bowl.

* * * * *